US010755839B2

(12) United States Patent
Kuo

(10) Patent No.: US 10,755,839 B2
(45) Date of Patent: Aug. 25, 2020

(54) RESISTOR ELEMENT

(71) Applicant: VIKING TECH CORPORATION, Hukou Township, Hsinchu County (TW)

(72) Inventor: Shun-Ho Kuo, Hukou Township, Hsinchu County (TW)

(73) Assignee: Viking Tech Corporation, Hsinchu County (TW)

( * ) Notice: Subject to any disclaimer, the term of this patent is extended or adjusted under 35 U.S.C. 154(b) by 0 days.

(21) Appl. No.: 16/296,723

(22) Filed: Mar. 8, 2019

(65) Prior Publication Data

US 2020/0185132 A1 Jun. 11, 2020

(30) Foreign Application Priority Data

Dec. 5, 2018 (TW) ..... 107143617 A

(51) Int. Cl.
*H01C 1/14* (2006.01)

(52) U.S. Cl.
CPC ..... *H01C 1/14* (2013.01)

(58) Field of Classification Search
CPC ..... H01C 1/14
See application file for complete search history.

(56) References Cited

U.S. PATENT DOCUMENTS 2,385,386 A * 9/1945 Stoffel ..... H01C 17/28 29/621
3,311,968 A * 4/1967 Ardouin ..... H01C 1/148 29/619
3,337,830 A * 8/1967 Levy ..... H01C 1/146 338/15
3,500,464 A * 3/1970 Brower ..... H05B 3/688 338/321
3,512,115 A * 5/1970 Solow ..... H01C 1/16 338/285
3,555,485 A * 1/1971 Solow ..... H01C 1/14 338/252
4,347,526 A * 8/1982 Elliott ..... H01L 27/14669 257/442
4,374,374 A * 2/1983 Goof ..... H01H 3/142 338/114
5,065,221 A * 11/1991 Imamura ..... H01C 17/23 219/121.68
6,004,471 A * 12/1999 Chuang ..... H01C 7/021 216/16

(Continued)

*Primary Examiner* — Kyung S Lee

(74) *Attorney, Agent, or Firm* — Muncy, Geissler, Olds & Lowe, P.C.

(57) ABSTRACT

A resistor element is provided, comprising a substrate including an upper surface and lower surface opposite to each other; a pair of electrodes separately disposed on the upper surface; at least one first groove extended from the upper surface to lower surface and defined by first side walls and a first bottom surface, wherein the depth from the upper surface of the substrate to the first bottom surface is a first depth; and a resistant layer disposed on the upper surface and electrical connected to the pair electrodes. The resistant layer covers the first side wall, the first bottom surface and part of the upper surface. The substrate with grooves increases the current path of the resistant layer, so that the resistor element having higher resistance can be obtained.

9 Claims, 7 Drawing Sheets

(56) References Cited

U.S. PATENT DOCUMENTS

| | | | | |
|---|---|---|---|---|
| 7,091,450 | B1 * | 8/2006 | Hollander | B62J 33/00 219/202 |
| 8,754,741 | B2 * | 6/2014 | Williams | H01L 23/5258 338/308 |
| 2015/0077216 | A1 * | 3/2015 | Frerejean | H01C 17/06 338/285 |

* cited by examiner

RESISTOR ELEMENT

BACKGROUND OF THE INVENTION

1. Field of the Invention

The present invention relates to a resistor element, particularly to a resistor element, wherein grooves are formed on the substrate to increase the current paths of the resistant layer.

2. Description of the Prior Art

Resistor elements are frequently used in electronic circuits. For various purposes in design, electronic circuits may need high-resistance resistor elements. Refer to FIG. 1. The conventional resistor element 10 comprises a substrate 1, a pair of electrodes 2, a resistant layer 3, protection layer 4 and solder pads 5. The resistant layer 3 is formed on the substrate 1 and electrically connected with the pair of electrodes 2. The resistant layer 3 is covered by the protection layer 4 and insulated from the external by the protection layer 4. As the resistant layer 3 is a 2-dimensional structure, the current paths thereof are constrained by the distances to the electrodes. Thus, the resistor element 10 is less likely to achieve higher resistance. Such a problem may impair the design of electronic circuits needing high-resistance resistor elements. Therefore, producing greater resistance in a given size of resistor element has been a target the manufacturers are eager to achieve.

SUMMARY OF THE INVENTION

Herein is provided a resistor element, wherein grooves are fabricated thereon to generate height drops between the upper surface of the substrate and the bottom surfaces of the grooves, increase the current paths in the resistant layer covering the grooves, and thus raise the resistance of the resistor element. For example, in the condition that the conventional resistor element and the resistor element of the present invention have an identical size, the resistor element of the present invention, which has grooves, has 110% to 700% the resistance of the conventional resistor element. Suppose that the conventional resistor element has a resistance of 100Ω. The resistor element of the present invention will have a resistance of 110Ω to 700Ω.

In one embodiment, the resistor element of the present invention comprises a substrate having an upper surface and a lower surface opposite to the upper surface; a pair of electrodes disposed in the upper surface of the substrate separately; at least one first groove extended from the upper surface of the substrate toward the direction of the lower surface of the substrate and defined by first side walls and a first bottom surface, wherein the distance from the upper surface of the substrate to the first bottom surface of the first groove is defined as a first depth H; and a resistant layer disposed on the upper surface of the substrate, electrically-connected with the pair of electrodes, and covering the first side walls and first bottom surface of the first groove and a portion of the upper surface.

In one embodiment, the resistor element comprises a plurality of first grooves; the resistant layer covers the first side walls and the first bottom surfaces of a portion of the first grooves or all the first grooves.

In one embodiment, the resistor element comprises a plurality of first grooves; the resistant layer covers a portion of or a whole of the first side walls and the first bottom surfaces of each of the first grooves.

In one embodiment, the first side wall and the first bottom surface has an included angle therebetween; the included angle ranges from 100 to 170 degrees; the first side wall inclines toward the exterior of the first groove with respect to the first bottom surface.

In one embodiment, the section of the first groove is an inverted trapezoid.

In one embodiment, the resistor element further comprises second grooves; the second groove is extended from the upper surface of the substrate toward the direction of the lower surface of the substrate and defined by second side walls and a second bottom surface; an electrode material is disposed on the second side walls and the second bottom surfaces of the second grooves to form the pair of electrodes.

In one embodiment, the resistor element further comprises a protection layer; the protection layer covers the resistant layer and the upper surface exposed from the resistant layer and is filled into the first groove.

In one embodiment, the resistor element further comprises third grooves; the third groove is extended from the upper surface of the substrate toward the direction of the lower surface of the substrate and defined by third side walls and a third bottom surface; the protection layer covers the third side walls and the third bottom surfaces of the third grooves and is filled into the third grooves.

In one embodiment, the distance from the electrode to the lower surface of the substrate is defined as a first distance; the first distance ranges from 10 μm to 3 mm.

In one embodiment, the first depth is 5% to 90% of the first distance.

In one embodiment, the resistor element of the present invention comprises a substrate having an upper surface and a lower surface opposite to the upper surface; a pair of electrodes separately disposed on the upper surface of the substrate; at least one first groove extended from the upper surface of the substrate toward the direction of the lower surface of the substrate and defined by first side walls and a first bottom surface, wherein a first depth is defined by a distance from the upper surface of the substrate to the first bottom surface of the first groove; a resistant layer disposed on the upper surface of the substrate, electrically connected with the pair of electrodes, and covering the first side walls, the first bottom surface and a portion of the upper surface; second grooves each extended from the upper surface of the substrate toward the direction of the lower surface of the substrate and defined by second side walls and a second bottom surface, wherein an electrode material is filled into the second grooves to form the pair of electrodes; and third grooves each extended from the upper surface of the substrate toward the direction of the lower surface of the substrate and defined by third side walls and a third bottom surface, wherein a protection layer covers the third side walls and the third bottom surfaces of the third grooves and is filled into the third grooves.

Below, embodiments are described in detail in cooperation with the attached drawings to make easily understood the objectives, technical contents, characteristics and accomplishments of the present invention.

DESCRIPTION OF THE PREFERRED EMBODIMENTS

Figure 1:
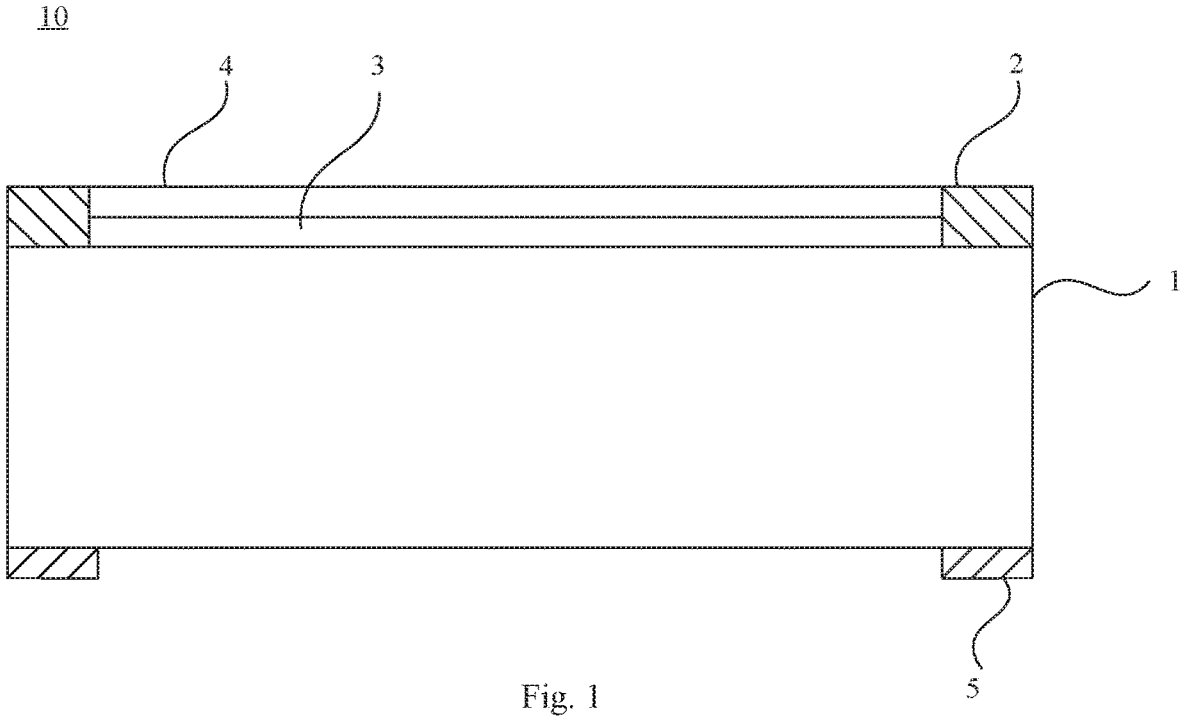
FIG. 1 is a sectional view schematically showing a conventional resistor element.

The present invention will be described in detail with embodiments and attached drawings below. However, these embodiments are only to exemplify the present invention but not to limit the scope of the present invention. In addition to the embodiments described in the specification, the present invention also applies to other embodiments. Further, any modification, variation, or substitution, which can be easily made by the persons skilled in that art according to the embodiment of the present invention, is to be also included within the scope of the present invention, which is based on the claims stated below. Although many special details are provided herein to make the readers more fully understand the present invention, the present invention can still be practiced under a condition that these special details are partially or completely omitted. Besides, the elements or steps, which are well known by the persons skilled in the art, are not described herein lest the present invention be limited unnecessarily. Similar or identical elements are denoted with similar or identical symbols in the drawings.

Figure 2:
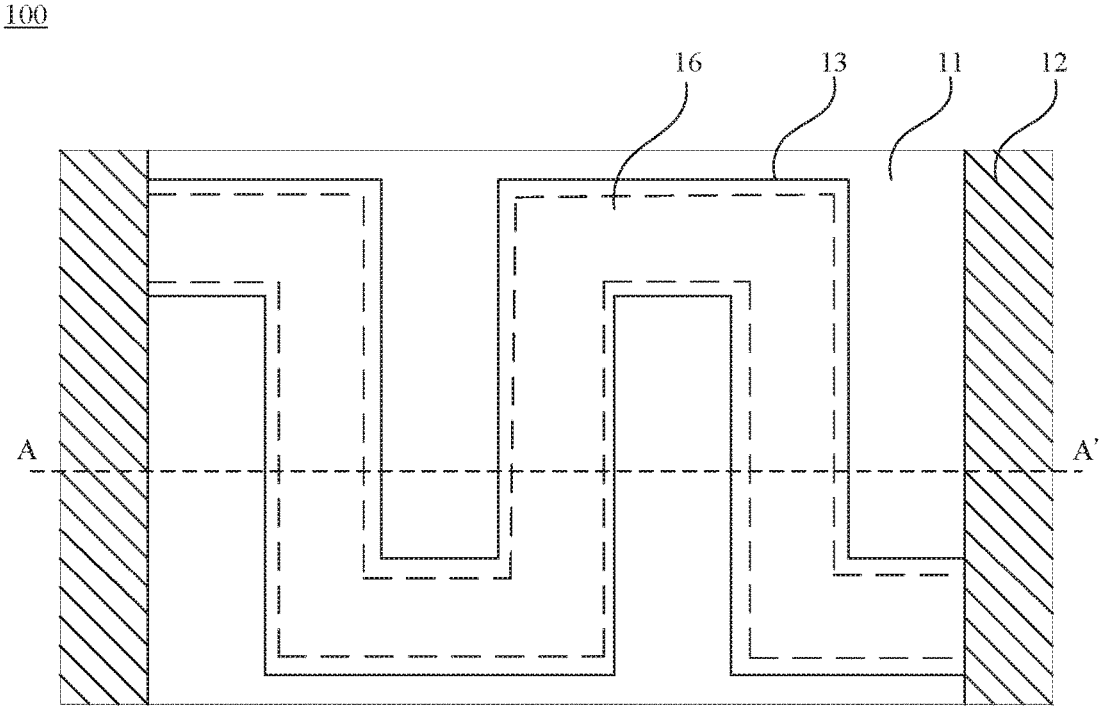
FIG. 2 is a top view schematically showing a resistor element 100 according to one embodiment of the present invention.
Figure 3:
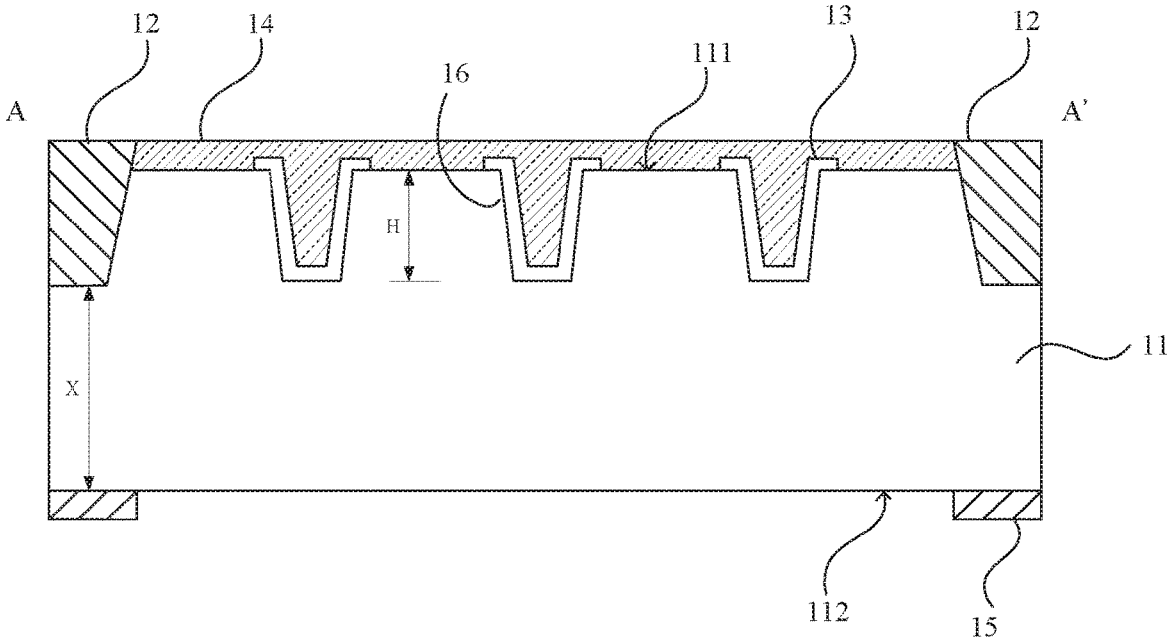
FIG. 3 is a sectional view taken along Line A-A' in FIG. 2 and schematically showing a resistor element 100 with a protection layer 14 according to one embodiment of the present invention.
Figure 4:
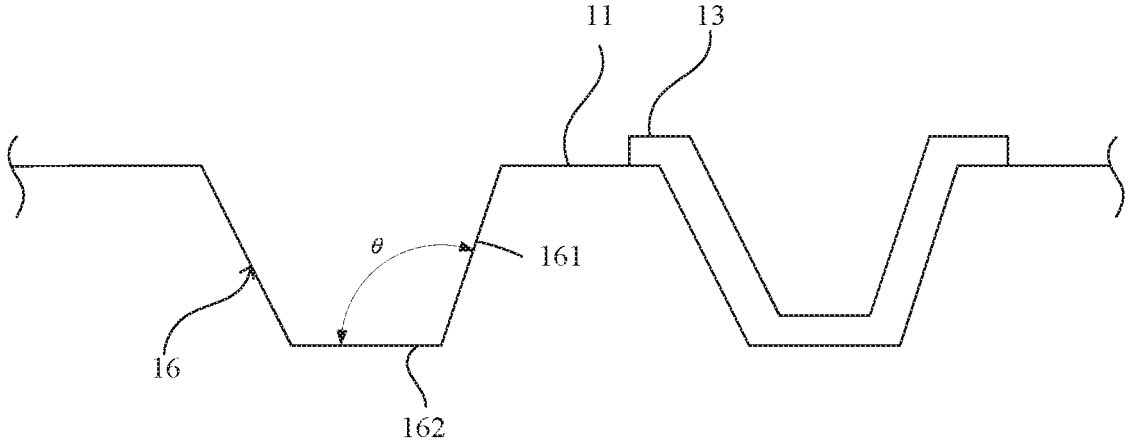
FIG. 4 is an enlarged view schematically showing a first groove and a resistant layer according to one embodiment of the present invention.

Refer to FIGS. 2-4. In one embodiment, the resistor element 100 of the present invention comprises a substrate 11, a pair of electrodes 12, at least one first groove 16, and a resistant layer 13. The substrate 11 has an upper surface 111 and a lower surface 112 opposite to the upper surface 111. The substrate 11 may be made of a ceramic material, a glass material, a resin material, a plastic material, or another insulating material. The pair of electrodes 12 are disposed in the upper surface 111 separately. The first groove 16 is extended from the upper surface 111 of the substrate 11 toward the direction of the lower surface 112 of the substrate 11 and defined by first side walls 161 and a first bottom surface 162. The distance from the upper surface 111 of the substrate 11 to the first bottom surface 162 of the first groove 16 is defined as a first depth H. The resistant layer 13 is disposed on the upper surface 111 of the substrate 11 and electrically connected with the pair of electrodes 12. The resistant layer 13 covers the first side walls 161 and first bottom surface 162 of the first groove 16 and a portion of the upper surface 111. However, the resistant layer 13 does not fill the first groove 13 completely. The resistor element 100 of the present invention may further comprise a protection layer 14, which covers the resistant layer 13 and the upper surface 111 exposed from the resistant layer 13. The resistor element 100 of the present invention may further comprise one or more solder pads 15, which are disposed on the lower surface 112 of the substrate 11.

Refer to FIG. 4. In one embodiment, the first side wall 161 of and the first bottom surface 162 of the first groove 16 has an included angle θ therebetween. The included angle θ ranges from 100 to 170 degrees. Thus, the first side wall 161 inclines toward the exterior of the first groove 16 with respect to the first bottom surface 162. In the embodiments shown in the attached drawings, the section of the first groove 16 is an inverted trapezoid. However, the present invention does not limit that the section of the first groove 16 must be an inverted trapezoid. In other embodiments, the section of the first groove 16 may be in form of another shape according to requirement.

In this embodiment, the distance between the upper surface 111 of the substrate 11 and the first bottom surface 162 of the first groove 16 is defined as a first depth H. The height drop between the upper surface 111 of the substrate 11 and the first bottom surface 162 of the first groove 16 increases the surface area of the resistant layer 13, which covers the first groove 16 and the substrate 11 and thus increases the current paths. Thus, although neither the distance to the pair of electrodes 12 nor the size of the resistor element 100 is increased, higher resistance is acquired. Therefore, the resistor element of the present invention has smaller size and higher resistance and is favorably applied to flexible display devices and wearable electronic devices. For example, in the condition that the conventional resistor element and the resistor element of the present invention have an identical size, the resistor element of the present invention, which has grooves, has 110% to 700% the resistance of the conventional resistor element. Suppose that the conventional resistor element has a resistance of 100Ω. The resistor element of the present invention will have a resistance of 110 Ω to 700Ω.

Figure 5:
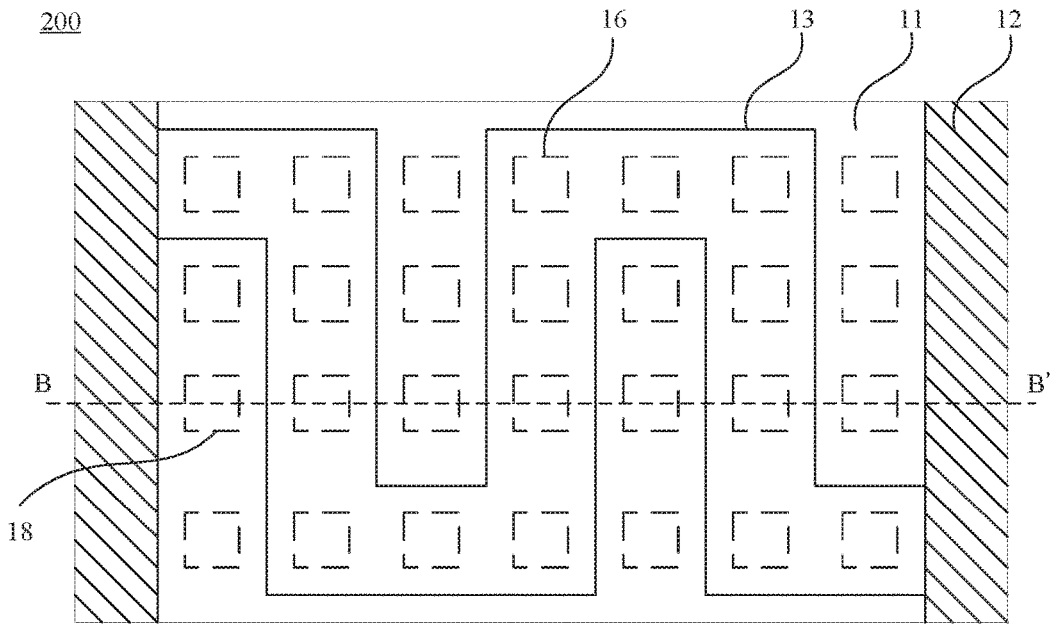
FIG. 5 is a top view schematically showing a resistor element 200 according to another embodiment of the present invention.
Figure 6:
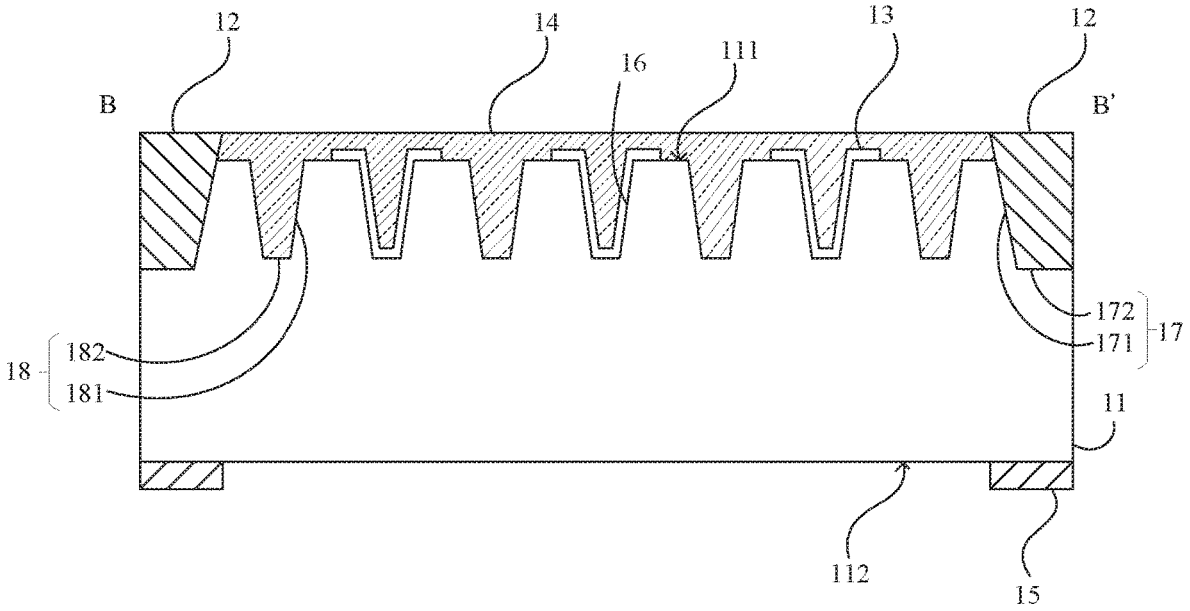
FIG. 6 is a sectional view taken along Line B-B' in FIG. 5 and schematically showing a resistor element 200 with a protection layer 14 according to another embodiment of the present invention.
Figure 7:
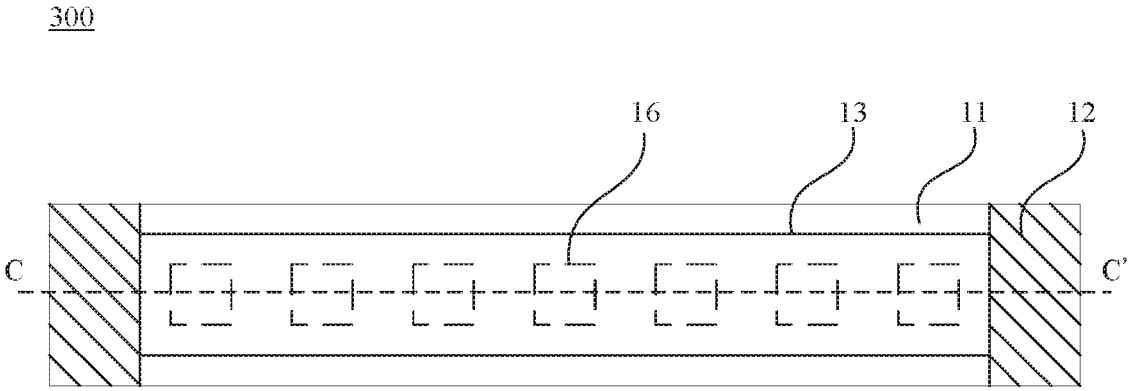
FIG. 7 is a top view schematically showing a resistor element 300 according to yet another embodiment of the present invention.
Figure 8:
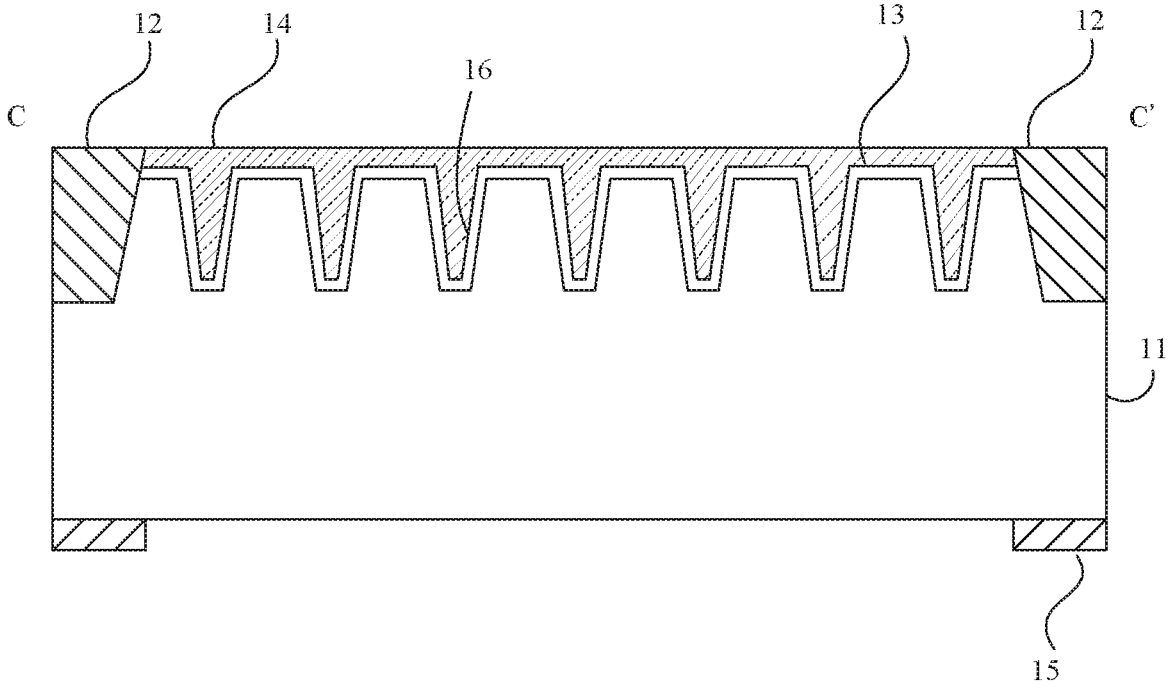
FIG. 8 is a sectional view taken along Line C-C' in FIG. 7 and schematically showing a resistor element 300 with a protection layer 14 according to yet another embodiment of the present invention.
Figure 9:
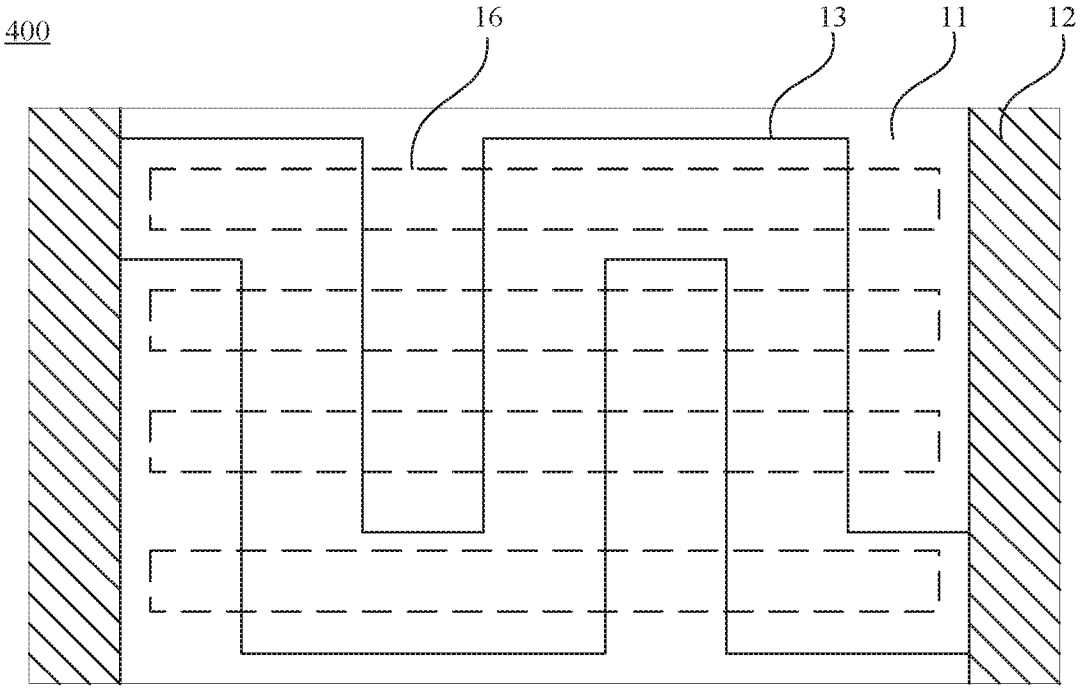
FIG. 9 is a top view schematically showing a resistor 400 according to further another embodiment of the present invention.
Figure 10:
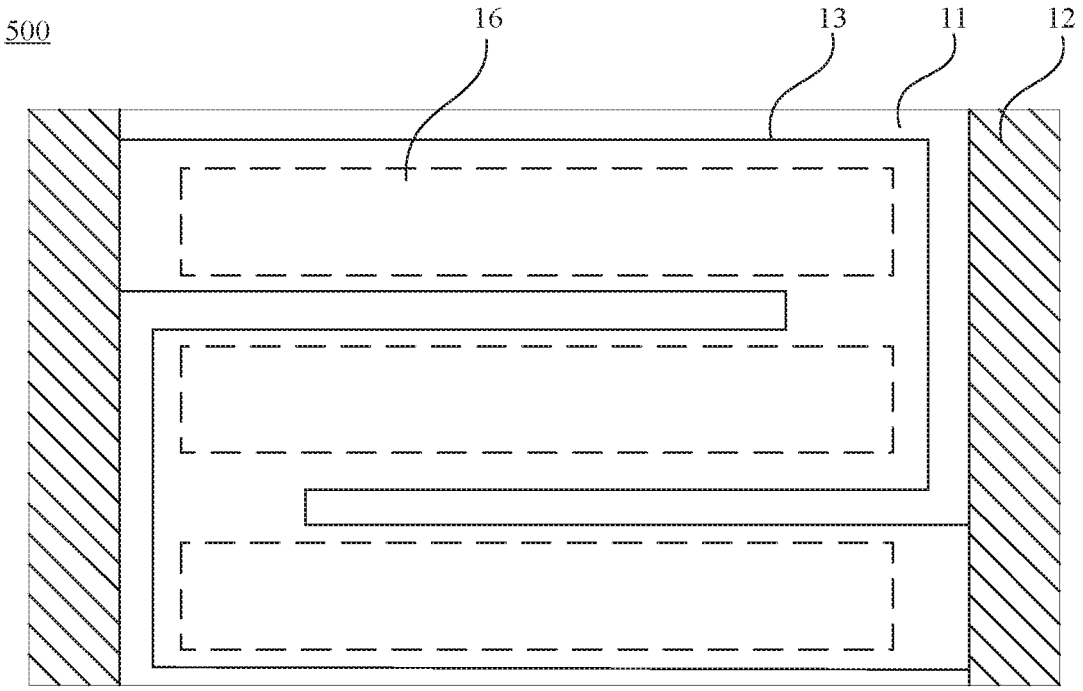
FIG. 10 is a top view schematically showing a resistor element 500 according to yet further another embodiment of the present invention.
Figure 11:
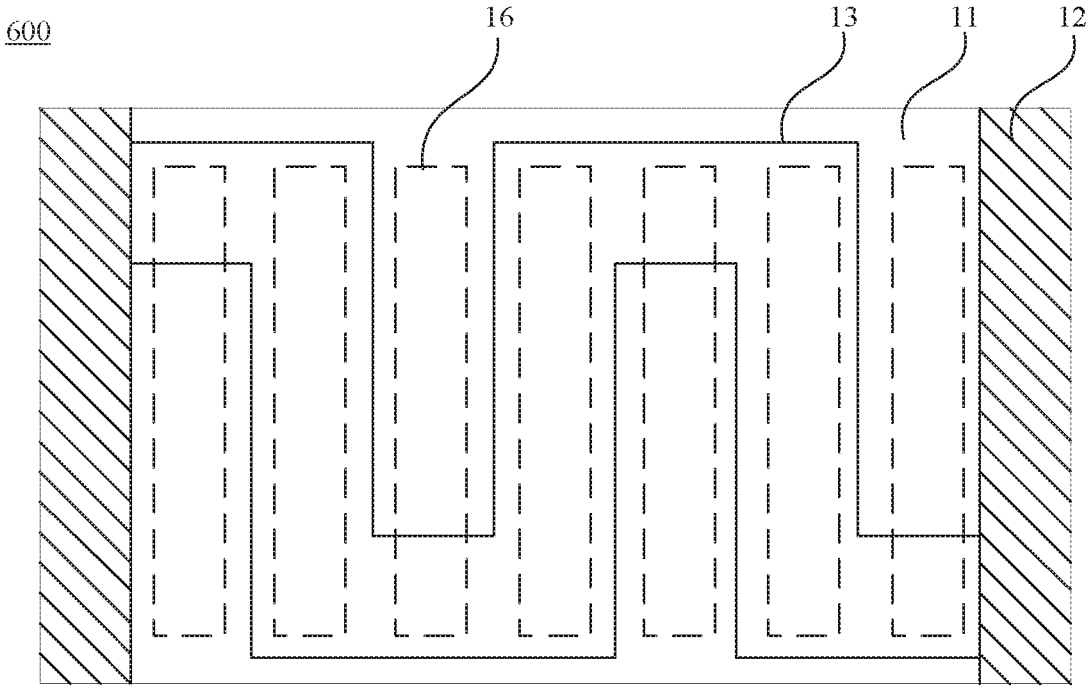
FIG. 11 is a top view schematically showing a resistor element 600 according to still further another embodiment of the present invention.
Figure 12:
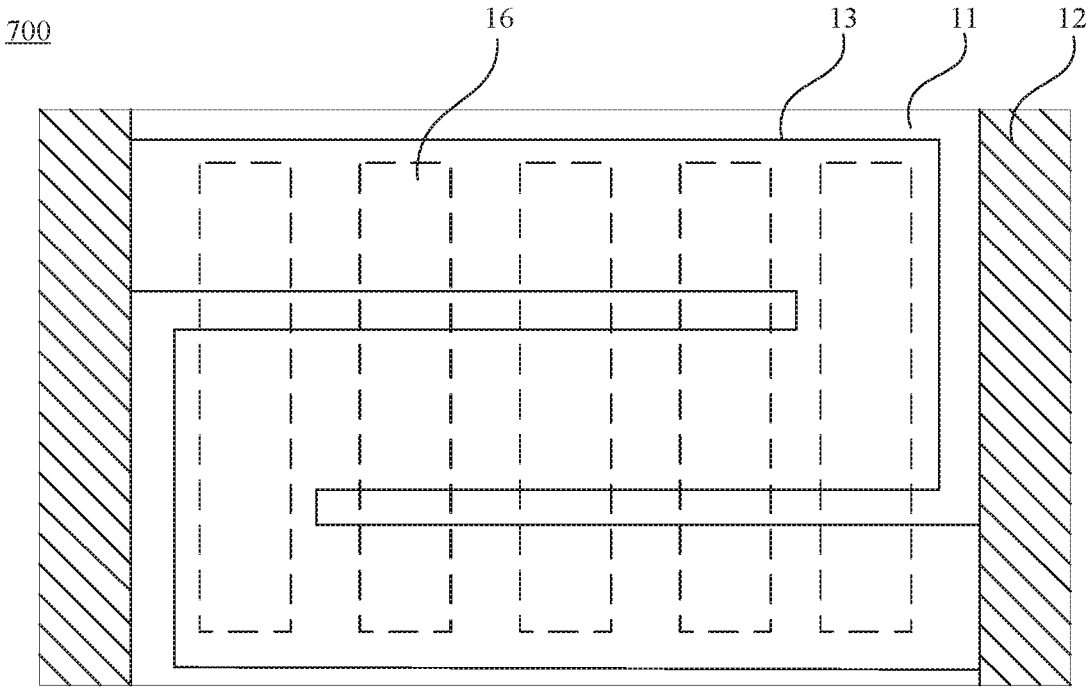
FIG. 12 is a top view schematically showing a resistor element 700 according to yet still further another embodiment of the present invention.

In the embodiment shown in FIG. 2, the present invention has a single first groove 16. However, the present invention is not limited by this embodiments. Refer to FIG. 5 and FIG. 6 for another embodiment of the present invention. In embodiment shown in FIG. 5 and FIG. 6, the resistor element 200 of the present invention comprises a plurality of first grooves 16. According to requirement, the resistant layer 13 covers one or more of the plurality of first grooves 16. Refer to FIG. 7 and FIG. 8 for yet another embodiment of the present invention. In the yet another embodiment, the resistor element 300 comprises a plurality of first grooves 16, and the resistant layer 13 covers all the first grooves 16, It should be noted: it is the first side walls 161 and the first bottom surfaces 162 that are covered by the resistant layer 13.

Refer to FIGS. 9 to 12. In other embodiments, each of the resistor elements 400, 500, 600 and 700 comprises a plurality of first grooves 16. According to requirement, the resistant layer 13 covers a portion of the first side walls 161 of each first groove 16 and a portion of the first bottom surface 162 of each first groove 16, or covers the whole first side walls 161 and the whole first bottom surface 162 of each first groove 16. It should be noted: the shape and number of the resistant 13 or the first groove 16 is not limited by the shapes and numbers depicted in the drawings. According to requirement, the resistant 13 or the first groove 16 may have a shape or number different from that shown in those drawings. It is easily understood: the rest of the first side walls 161 and the first bottom surfaces 162, which are not completely covered by the resistant layer 13, is covered by the protection layer. Further, the protection layer is filled into each of the first grooves 16.

In the embodiment shown in FIG. 6, the resistor element 200 of the present invention further comprises second grooves 17. The second groove 17 is extended from the upper surface 111 of the substrate 11 toward the direction of the lower surface 112 and defined by a second side wall 171 and a second bottom surface 172. An electrode material is filled into the space between the second side wall 171 and the second bottom surface 172 to form the pair of electrodes 12. The electrode material is selected from a group including silver (Ag), copper (Cu), gold (Au) or aluminum (Al).

In the embodiment shown in FIG. 6, the resistor element 200 of the present invention further comprises third grooves 18. The third groove 18 is extended from the upper surface 111 of the substrate 11 toward the direction of the lower surface 112 and defined by third side walls 181 and a third bottom surface 182. In this embodiment, the protection layer 14 covers the resistant layer 13 and the upper surface 111 of the substrate 11, which is exposed from the resistant layer 13. The protection layer 14 also covers the third side walls 181 and the third bottom surfaces 182. Further, the whole third groove 18 is filled up with the protection layer 14.

Refer to FIG. 3 again. In some embodiments, the distance from the electrode 12 to the lower surface 112 of the substrate 11 is defined as a first distance X. The first distance X ranges from 10 μm to 3 mm. The first depth H, which is the distance from the upper surface 111 of the substrate 11 to the first bottom surface 162 of the first groove 16, is 5% to 90% of the first distance X.

In conclusion, the groves of the resistor element of the present invention generates height drops from the upper surface of the substrate to the bottom surface of the grooves, increases the surface area of the resistant layer covering the grooves and the substrate, and thus increases the current paths. Therefore, the present invention can provide a resistor element with higher resistance, neither varying the distance to the electrodes nor increasing the size of the resistor element.

What is claimed is:

1. A resistor element comprising a substrate having an upper surface and a lower surface opposite to the upper surface;

a pair of electrodes separately disposed on the upper surface of the substrate;

a plurality of first grooves extended from the upper surface of the substrate toward a direction of the lower surface of the substrate and defined by first side walls and first bottom surfaces, wherein a first depth is defined by a distance from the upper surface of the substrate to the first bottom surfaces of the first grooves;

a resistant layer disposed on the upper surface of the substrate, electrically connected with the pair of electrodes, and covering the first side walls and the first bottom surfaces of a portion of the first grooves or all the first grooves and a portion of the upper surface; and second grooves, wherein the second groove is extended from the upper surface of the substrate toward a direction of the lower surface of the substrate and defined by second side walls and a second bottom surface; an electrode material is filled into the second grooves to form the pair of electrodes.

2. The resistor element according to claim 1, wherein the resistant layer covers a portion of or a whole of the first side walls and the first bottom surfaces of each of the first grooves.

3. The resistor element according to claim 1, wherein the first side walls and the first bottom surfaces have an included angle therebetween; the included angle ranges from 100 to 170 degrees; the first side walls incline toward exterior of the first grooves with respect to the first bottom surfaces.

4. The resistor element according to claim 1, wherein a section of the first grooves is an inverted trapezoid.

5. The resistor element according to claim 1 further comprising a protection layer, wherein the protection layer covers the resistant layer and the upper surface exposed from the resistant layer and is filled into the first grooves.

6. The resistor element according to claim 5 further comprising third grooves, wherein the third groove is extended from the upper surface of the substrate toward a direction of the lower surface of the substrate and defined by third side walls and a third bottom surface; the protection layer covers the third side walls and the third bottom surfaces of the third grooves and is filled into the third grooves.

7. The resistor element according to claim 1, wherein a distance from the electrode to the lower surface of the substrate is defined as a first distance; the first distance ranges from 10 μm to 3 mm.

8. The resistor element according to claim 7, wherein the first depth is 5% to 90% of the first distance.

9. A resistor element comprising a substrate having an upper surface and a lower surface opposite to the upper surface;

a pair of electrodes separately disposed on the upper surface of the substrate;

a plurality of first grooves extended from the upper surface of the substrate toward a direction of the lower surface of the substrate and defined by first side walls and first bottom surfaces, wherein a first depth is defined by a distance from the upper surface of the substrate to the first bottom surfaces of the first grooves;

a resistant layer disposed on the upper surface of the substrate, electrically connected with the pair of electrodes, and covering the first side walls and the first bottom surfaces of a portion of the first grooves or all the first grooves and a portion of the upper surface;

second grooves, wherein each of the second grooves is extended from the upper surface of the substrate toward a direction of the lower surface of the substrate and defined by second side walls and a second bottom surface; an electrode material is filled into the second grooves to form the pair of electrodes; and third grooves, wherein each of the third groove is extended from the upper surface of the substrate toward a direction of the lower surface of the substrate and defined by third side walls and a third bottom surface;

a protection layer covers the third side walls and the third bottom surfaces of the third grooves and is filled into the third grooves.

* * * * *